US010682691B2

(12) United States Patent
Marcin et al.

(10) Patent No.: US 10,682,691 B2
(45) **Date of Patent: *Jun. 16, 2020**

(54) OXIDATION RESISTANT SHOT SLEEVE FOR HIGH TEMPERATURE DIE CASTING AND METHOD OF MAKING

(71) Applicant: United Technologies Corporation, Farmington, CT (US)

(72) Inventors: John Joseph Marcin, Marlborough, CT (US); Dilip M. Shah, Glastonbury, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 74 days.

This patent is subject to a terminal disclaimer.

(21) Appl. No.: 15/608,735

(22) Filed: May 30, 2017

(65) Prior Publication Data

US 2018/0345360 A1 Dec. 6, 2018

(51) Int. Cl.

| | |
|---|---|
| ***B22D 17/20*** | (2006.01) |
| ***C22C 19/03*** | (2006.01) |
| ***C23C 8/12*** | (2006.01) |

(52) U.S. Cl.

CPC ..... *B22D 17/2023* (2013.01); *C22C 19/03* (2013.01); *C23C 8/12* (2013.01)

(58) Field of Classification Search

CPC ..... B22D 17/2023

See application file for complete search history.

(56) References Cited

U.S. PATENT DOCUMENTS

| | | | | |
|---|---|---|---|---|
| 3,735,797 | A * | 5/1973 | Jeanneret | B22C 3/00 164/267 |
| 3,754,902 | A | 8/1973 | Boone et al. | |
| 4,895,201 | A | 1/1990 | Decrescente et al. | |
| 5,366,695 | A | 11/1994 | Erickson | |
| 6,007,645 | A | 12/1999 | Cetel et al. | |
| 6,500,283 | B1 | 12/2002 | Schaeffer et al. | |
| 6,736,188 | B2 | 5/2004 | Vining et al. | |
| 7,056,395 | B1 * | 6/2006 | Guha | B22C 9/061 148/426 |
| 9,359,658 | B2 | 6/2016 | Innocenti et al. | |
| 9,481,917 | B2 | 11/2016 | Bochiechio et al. | |
| 9,551,049 | B2 | 1/2017 | Shah et al. | |
| 10,245,637 | B2 * | 4/2019 | Marcin | B22D 17/2023 |
| 2012/0111525 | A1 * | 5/2012 | Bochiechio | B22D 17/2209 164/113 |

(Continued)

FOREIGN PATENT DOCUMENTS

WO 9424320 A1 10/1994

OTHER PUBLICATIONS

European Search Report for European Application No. 18174043.2 dated Jul. 12, 2018, 9 pages.

*Primary Examiner* — Kevin E Yoon
*Assistant Examiner* — Jacky Yuen
(74) *Attorney, Agent, or Firm* — Cantor Colburn LLP

(57) ABSTRACT

Shot sleeves for high temperature die casting include a low modulus single crystal nickel-based alloy having less than 1 ppm sulfur, a low modulus single crystal nickel-based alloy doped with a sulfur active element, a low modulus single crystal nickel-based alloy having a protective oxide coating, or a combination of two or more of the foregoing.

19 Claims, 2 Drawing Sheets

(56) References Cited

U.S. PATENT DOCUMENTS

| | | | |
|---|---|---|---|
| 2012/0111526 | A1 | 5/2012 | Bochiechio et al. |
| 2016/0311015 | A1 | 10/2016 | Kwang et al. |
| 2018/0056380 | A1 | 3/2018 | Marcin et al. |

* cited by examiner

OXIDATION RESISTANT SHOT SLEEVE FOR HIGH TEMPERATURE DIE CASTING AND METHOD OF MAKING

BACKGROUND

The subject matter disclosed herein generally relates to a shot sleeve for a die casting process and, more particularly, to oxidation resistant shot sleeves for high temperature die casting.

A die casting process utilizes a mold cavity defined between mold parts. Molten metal material is fed into the mold cavity and held under pressure until the metal hardens. The mold parts are then separated and the cast part removed. In some processes a shot sleeve is utilized to receive molten material from a metal melting source and introduce that material to the cavity. The shot sleeve includes an opening for introducing molten material into a bore of the shot sleeve that leads to the mold cavity. A plunger or piston moves within the bore of the shot sleeve to push the molten material through the shot sleeve and inject the molten material into the mold cavity. The piston is subsequently withdrawn and additional material can be introduced into the bore for fabricating another part within the same mold cavity, i.e., the shot sleeve is reused for multiple molding operations (e.g., die casting operations).

The shot sleeve can experience very high temperatures due to the molten metal material that is passed through the bore of the shot sleeve. Accordingly, the shot sleeve and/or components thereof are fabricated of materials compatible with such high temperatures. However, materials that are compatible with the high temperatures encountered during the die casting process can be costly and difficult to machine. Further, materials that are compatible with the high temperatures may result in shot sleeves with relatively low life cycles. That is, the high temperatures can lead to failure of the shot sleeves, even when the shot sleeve is formed from high temperature materials. Single crystal nickel-based alloys have been proposed for use in shot sleeves. However, uncontrolled oxidation of the single crystal nickel-based alloy can result in issues and decreased shot sleeve life. Oxidation can occur whenever the temperature of the shot sleeve is exposed to oxygen at a sufficient temperature. Accordingly, it is desirable to design and develop shot sleeves that can withstand the high temperatures and are resistant to oxidation.

SUMMARY

Disclosed herein is a shot sleeve for high temperature die casting comprising a low modulus single crystal nickel-based alloy having less than 1 ppm sulfur, a low modulus single crystal nickel-based alloy doped with a sulfur active element, a low modulus single crystal nickel-based alloy having a protective oxide coating, or a combination of two or more of the foregoing. In some embodiments the low modulus single crystal, nickel-based alloy has less than 0.5 ppm sulfur.

In some embodiments the low modulus single crystal, nickel-based alloy is doped with one or more elements with consecutive atomic numbers of 57 to 71, inclusive, or yttrium. In some embodiments the dopant is present in an amount of 1 to 1000 ppm.

In some embodiments the protective oxide coating is formed in the presence of MgO, $Fe_2O_3$, $Cr_2O_3$, BaO, CaO, NiO, $Li_2O$, $Na_2O$, FeO, $Ta_2O_5$, $Y_2O_3$, $Gd_2O_3$, $SiO_2$, $ZrO_2$, $Ga_2O_3$, CoO, AlN, $Al_4C_3$, $Ni_2Mg$, $NiMg_2$, $Co_2Mg$, $MgCl_2MgF_2$, Fe, $MgAl_2O_4$, $MgZrAl_2O_6$, $Al_2O_3$, or a combination thereof. In some embodiments, the protective oxide coating has a thickness of 0.0001 to 0.005 inches. In some embodiments, the protective oxide coating is substantially continuous over the interior of the shot sleeve.

In some embodiments the protective oxide coating is applied to the shot sleeve. In some embodiments the protective oxide coating is formed from one or more metals in the low modulus single crystal nickel-based alloy.

Also described herein is a method of reducing oxidation of a high temperature die casting shot sleeve comprising: reducing the sulfur content in a low modulus, single crystal nickel-based alloy to less than 1 ppm; doping a low modulus, single crystal nickel-based alloy with a sulfur active agent; providing a protective oxide coating, or a combination of two or more of the foregoing. In some embodiments the sulfur content of the low modulus single crystal, nickel-based alloy is reduced to less than 0.5 ppm sulfur.

In some embodiments, the low modulus single crystal, nickel-based alloy is doped with one or more elements with consecutive atomic numbers of 57 to 71, inclusive, or yttrium. The dopant may be used in an amount of 1 to 1000 parts per million (ppm).

In some embodiments, the protective oxide coating is formed in the presence of MgO, $Fe_2O_3$, $Cr_2O_3$, BaO, CaO, NiO, $Li_2O$, $Na_2O$, FeO, $Ta_2O_5$, $Y_2O_3$, $Gd_2O_3$, $SiO_2$, $ZrO_2$, $Ga_2O_3$, CoO, AlN, $Al_4C_3$, $Ni_2Mg$, $NiMg_2$, $Co_2Mg$, $MgCl_2MgF_2$, Fe, $MgAl_2O_4$, $MgZrAl_2O_6$, $Al_2O_3$, or a combination thereof. The protective oxide coating may have a thickness of 0.0001 to 0.005 inches. The protective oxide coating may be substantially continuous over the interior of the shot sleeve. The protective oxide coating may be formed at a temperature of 1050 to 1370° C. The protective oxide coating may be formed during casting. The protective oxide coating may be applied to the shot sleeve.

Technical effects of embodiments of the present disclosure include a low modulus shot sleeve for high temperature die casting. Further technical effects include a shot sleeve with improved life cycle and durability for high temperature die casting.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1A:
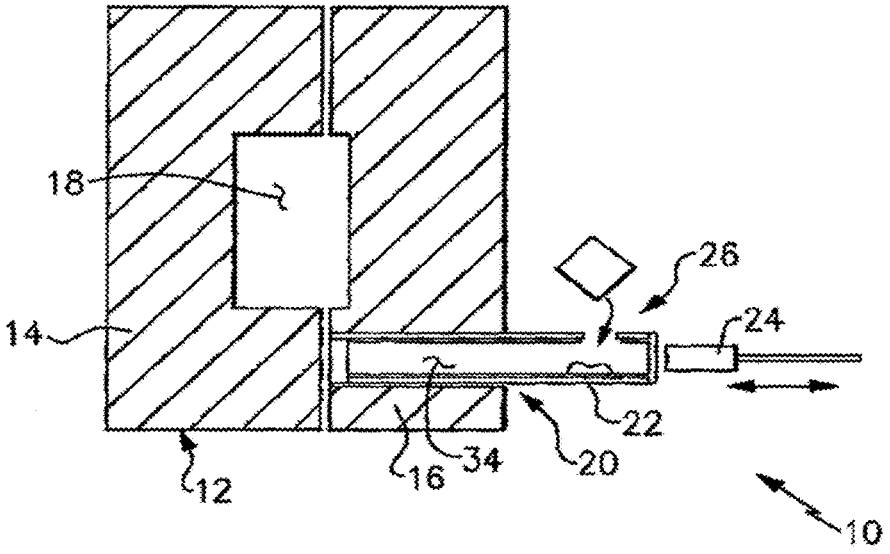
FIG. 1A is a schematic illustration of an example mold assembly that can incorporate embodiments described herein.

As shown and described herein, various features of the disclosure will be presented. Various embodiments may have the same or similar features and thus the same or similar features may be labeled with the same reference numeral, but preceded by a different first number indicating the Figure Number to which the feature is shown. Thus, for example, element "a" that is shown in FIG. X may be labeled "Xa" and a similar feature in FIG. Z may be labeled "Za." Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

FIG. 1A schematically illustrates an example die casting mold assembly 10 that includes a die casting mold 12 having a first part 14 and a second part 16 that define a mold cavity 18. The die casting mold 12 includes an opening 20 that receives a shot sleeve 22. The shot sleeve 22 defines a bore 34 through which molten material 26 can be injected into the mold cavity 18. A piston 24 operable and movable within the bore 34 of the shot sleeve 22 to inject the molten material 26 into the mold cavity 18. In some die casting operations, the molten material 26 can be heated to temperatures in excess of 2000° F. (1093° C.) in order to ensure proper fluidity of the molten material 26. That is, the temperatures are high enough to ensure that the molten material 26 can be pushed through the bore 34 of the shot sleeve 22 by the piston 24. In view of this, the material used to form the shot sleeve 22 must be compatible with the excessive temperatures of the molten material 26.

Figure 1B:
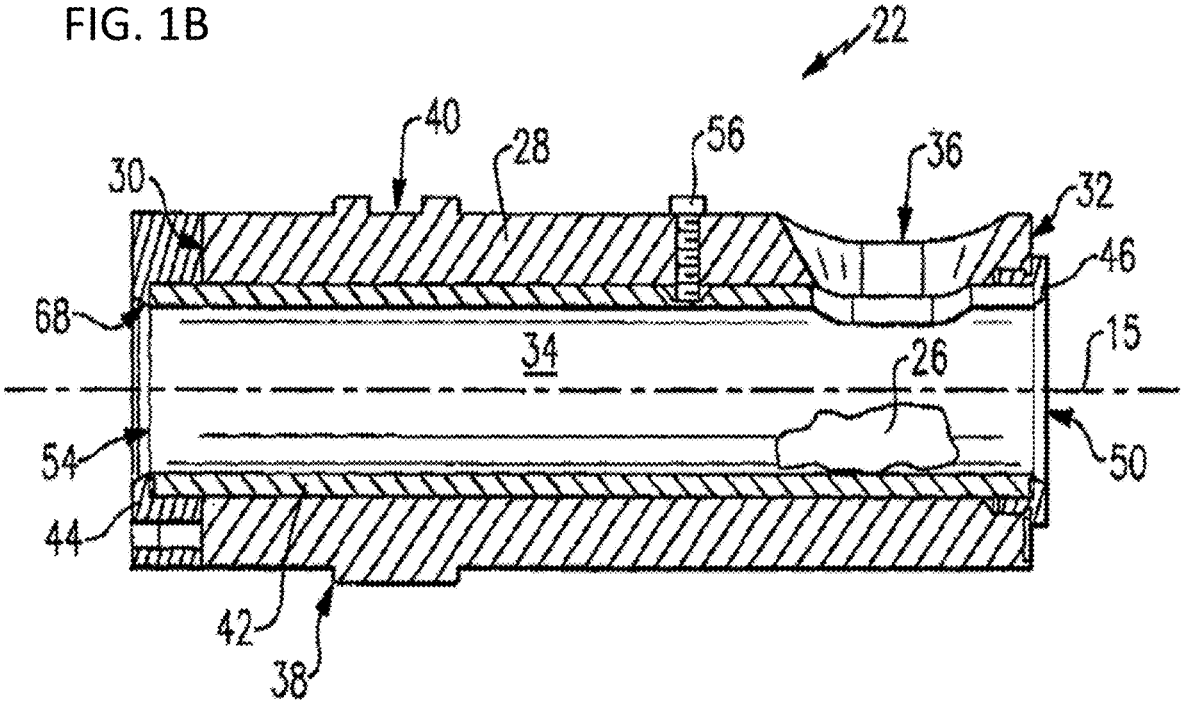
FIG. 1B is a cross-section schematic illustration of the shot sleeve of the mold assembly of FIG. 1A.

Referring to FIG. 1B, the shot sleeve 22 includes a housing 28 with a first end 30 and a second end 32. The bore 34 is defined within the housing 28 about a longitudinal axis 15 and extends from the first end 30 to the second end 32. The bore 34 is opened at both the first and second ends 30, 32, and thus defines a fluid passage within the shot sleeve 22. The first end 30 includes a first end opening 54 that fluidly connects the bore 34 with the mold cavity 18 when the shot sleeve 22 is connected to the die casting mold 12. As shown, in some configurations, the shot sleeve 22 can include a core 42. The core 42 is received within the bore 34 and can provide an interior surface capable of withstanding the temperatures of the molten material 26.

The shot sleeve 22 illustrated in FIG. 1B includes a first cover 44 that is attachable to the housing 28 by fasteners or other attachment mechanism. The first cover 44 is fabricated from a material determined to withstand the impact and wear encountered due to interaction with the die casting mold assembly 10. The first cover 44 includes an opening that is part of the first end opening 54

The first cover 44, as shown, is a separate piece from the housing 28 and thereby may be removed and replaced without having to replace the entire housing 28. Similarly, the core 42 is fit within the bore 34 of the housing 28 such that it may be removed and replaced due to wear and/or if damaged without replacing the entire shot sleeve 22. The first cover 44 includes a shoulder 68 against which the core 42 abuts at the first end 54.

A second cover 46 is attached to the housing 28 at the second end 32. The second end 32 of the housing 28 and the second cover 46 includes a second end opening 50 through which the piston 24 may be inserted and move therethrough to drive the molten material 26 through the shot sleeve 22 and out the first end opening 54. Molten material 26 can be poured through a supply opening 36 such that the molten material 26 can fill the bore 34.

An optional key 56 can extend through the housing 28, as shown in FIG. 1B, and engage a surface of the core 42 to prevent rotation of the core 42 relative to the housing 28 and to maintain an alignment of the openings 50, 54. The housing 28 further includes an integral collar portion 38 formed on an exterior surface of the housing 28, including flats 40 that are utilized and provide for engagement of a tool, as known in the art. Additional flanges and/or other structures can be configured on the exterior surface of the housing 28.

The die casting mold assembly 10, as noted above, is subject to high temperatures due to the manufacturing process of a component formed within the die casting mold 12. Because of the high temperatures, the components of the die casting mold assembly 10 may suffer low part life (e.g., relatively low number of operations before one or more components should be replaced or repaired). Accordingly, as provided herein, improved shot sleeves having drastically improved part life are described.

For example, machines capable of high temperature die casting of aerospace components may require molten nickel-based alloy. In such manufacturing, metal is melted in a crucible (e.g., molten material 26) and poured through the supply opening 36 into the bore 34 of the shot sleeve 22. The piston 24 is positioned and inserted into the bore 34 and injects the molten material 26 into the die casting mold at high velocity and pressure. The molten material 26 fills the mold cavity 18 which defines a part geometry, such as several aerospace components, and the molten material 26 cools within the mold cavity 18 to solidify and form a finished part or component. The first part 14 and second part 16 of the die casting mold 12 are then separated or opened, the solidified part(s) ejected from the die casting mold 12, and the cycle initiates again. This is referred to as a "shot cycle" (i.e., the full process of forming a component with the die casting mold assembly 10.

It is advantageous to maximize the number of shot cycles that can be performed before components of the die casting mold assembly 10 exposed to the molten material 26 need to be replaced. In particular the shot sleeve 22 must remain dimensionally accurate for clearance and movement of the piston 24 while being exposed to the high temperature of the molten material 24 that is poured into the bore 34 before and after metal injection. As known in the art, the shot sleeve can fail from thermal mechanical fatigue induced by the rapid introduction and expulsion of the molten material 26 through in each shot cycle. An additional issue is the effect of oxidation on the shot sleeve. Oxidation can lead to fatigue initiation sites which will reduce the useful life of the shot sleeve as well as accelerate erosion of the shot sleeve. Erosion of the shot sleeve will introduce dimensional distortion and negatively impact molding. Sulfur, if present in the single crystal nickel-based alloy, can hinder the adhesion of a protective layer of oxidation. The resulting spallation of the protective oxide coating can result in oxidation of the shot sleeve itself, particularly since a new protective oxide coating is unlikely to form or adhere to the shot sleeve.

As provided herein, an extended-life shot sleeve formed of materials with superior thermal-mechanical fatigue resistance and oxidation resistance are disclosed. In accordance with some embodiments, an example material for such application (e.g., formation of the shot sleeve) is a single crystal nickel-based alloy which can be grown to orient a low modulus direction in the axial and tangential or hoop directions. Axial and tangential or hoop low modulus shot sleeve can be fabricated and made in the size of a die casting shot sleeve as described herein. The single crystal nickel-based alloy may comprise less than 1 part per million (ppm) sulfur, the single crystal nickel-based alloy may be doped with a sulfur active element, the shot sleeve comprising the single crystal nickel-based alloy may comprise a protective oxide coating or a combination of two or more of these approaches may be used. The protective oxide coating may form from the exposure of the low modulus single crystal nickel-based alloy to oxygen at temperatures of 1050° C. to 1370° C. or a protective oxide coating may be applied to the shot sleeve.

In some embodiments the single crystal nickel-based alloy comprises less than 0.5 ppm sulfur, or, less than 0.3 ppm sulfur. In some embodiments there is no sulfur detectable by glow discharge mass spectrometry (GDMS) or combustion analysis. Sulfur can be present in the materials used to make the nickel-based alloy. Sulfur can be removed from the alloy by bubbling a gaseous desulfurizing compound through the molten alloy to form a solid sulfur containing waste and a molten reduced sulfur alloy. Exemplary desulfurizing compounds are taught in U.S. Pat. No. 9,481,917. In some embodiments, sulfur is reduced and/or removed from the materials used to make the alloy prior to the alloy formation. Thus there is no need to treat the alloy to a desulfurization step. In other embodiments the materials used to make the alloy are chosen to have low to undetectable levels of sulfur and do not need to be desulfurized.

The single crystal nickel-based alloy may be doped with a sulfur active element or combination of sulfur active agents. Exemplary sulfur active agents include elements with consecutive atomic numbers of 57 to 71, inclusive, and yttrium, atomic number 39. These sulfur active agents are added and the oxidation resistance of components made from such compositions is improved because the protective oxide coating which forms on the component surface has greater resistance to spallation during use. See, e.g., U.S. Pat. No. 3,754,902 to Boone et al. The dopant is used in an amount of 1 to 1000 ppm, or 10 to 500 ppm.

The single-crystal, nickel-based alloy shot sleeve is cast with a controlled modulus of the nickel crystal. By controlling the modulus of the nickel crystal during casting, a low modulus direction (e.g., cubic geometry) can be achieved with a high ductility orientation. In some embodiments, the casting of the shot sleeve can be achieved by growing a single-crystal, nickel-based alloy ingot and then forging the ingot into a shot sleeve (e.g., having a structural shape similar to that shown in FIG. 1B).

To achieve the shot sleeve described herein, an ingot of single-crystal, nickel-based alloy can be grown. The ingot can then be slow cooled, heat treated to soften the material. The softened material can then be forged to form the shot sleeve shape, size, and dimensions. The formed shape can then be heat treated to achieve a fine textured sub-grained structure that exhibits improved strength and low cycle fatigue.

A conventional single crystal does not have axial symmetry. However, by a special seeding process a single crystal, axial symmetry can be achieved, thus resulting in improved-life materials, and, accordingly, improved-life shot sleeves. Axial symmetry may also be achieved by bending a sheet of single crystal in its softened stage and welding the two edges to form a cylindrical tube.

In one embodiment of the present disclosure, a nickel-based alloy shot sleeve is provided. The nickel-based alloy shot sleeve is a single crystal grown to have a controlled modulus of the crystal. For example, in some embodiments, the atoms of the grown nickel-based alloy crystal can have a cubic geometry that provides a low modulus direction, resulting in a low thermally driven stress orientation.

Figure 2:
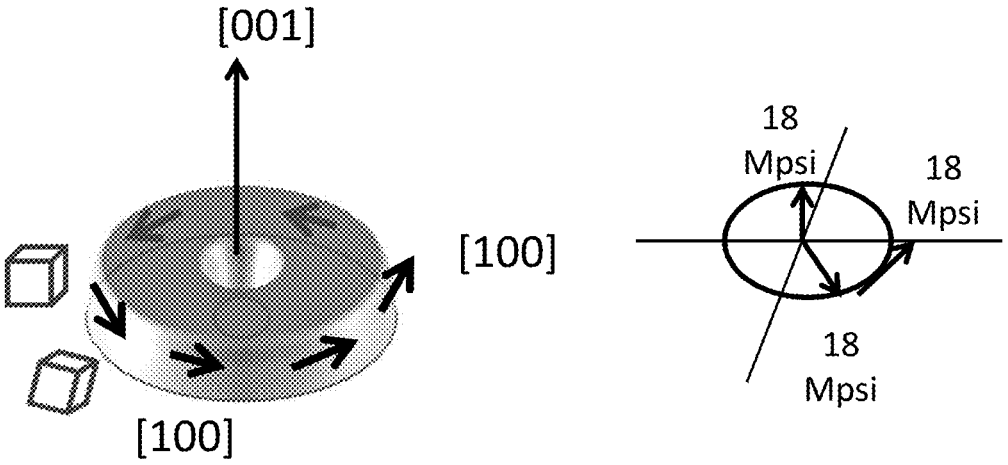
FIG. 2 illustratively shows a specially cast single crystal orientation as employed by embodiments of the present disclosure where both axial and hoop directions everywhere are low modulus.

As shown in FIG. 2, an orientation as employed by embodiments of the present disclosure is illustratively shown. As illustrated, a cubic geometry is formed by a normally used single crystal casting technique. This case, low modulus occurs tangentially every 90° interval. These locations can be selectively oriented at the bottom of the shot tube where liquid metal will flow. Such selection and orientation may provide improved and unexpected benefits of significant life-cycle of the shot sleeves of the present disclosure.

The modulus of the material provided herein may have a first axis having a modulus of 18-22 Mpsi, and in some embodiments, having a modulus of 28-32 Mpsi at room temperature. Further, in some embodiments, a radial direction may have a modulus of 18-22 Mpsi, and in some embodiments may have a modulus of 28-32 Mpsi. In all cases, the tangential or hoop modulus at room temperature may be preferred to be 18-22 Mpsi.

In accordance with various embodiments, the nickel-based, single crystal alloy can include various different materials. For example, alloys of the present disclosure may take the form of Ni-$M_1M_2$- . . . -$M_n$, wherein $M_1$ to $M_n$ are metals that are alloyed with nickel to achieve the desired properties. In various embodiments, a single additional metal ($M_1$) may be alloyed with nickel, and in other various embodiments different numbers of alloyed metals $M_1$ to $M_n$ can be employed. In some embodiments, the alloyed metals may include solid solution hardened alloys such as Hastelloy-X® or low volume fraction precipitation hardened alloy such as Waspaloy®, or high volume fraction low density precipitation hardened alloy such as Inconel® Alloy 100, or high density but creep resistant alloys such as PWA 1484, René N5, or CMSX-4 alloy, or even dual precipitation hardened alloy such as Inconel® Alloy 718. Additionally, as will be appreciated by those of skill in the art, the different materials (including nickel-based or iron-based or steels) may take different weight percentages, as illustrated by the preceding example(s) and understood by those of skill in the art.

In addition to the above described shot sleeves, in some embodiments, the formation and casting of the shot sleeve may be configured to form cooling channels within the shot sleeve. That is, in addition to providing the above described and formed shot sleeve that is formed from the described nickel-based alloy, additional features, such as cooling channels can be employed to further improve efficiency and/or part life, as desired and/or necessary.

The single-crystal, nickel-based alloy with a low modulus, because of a high thermal-mechanical fatigue resistance, can eliminate the core 42. That is, the entire shot sleeve can be formed as a single unitary component that is formed from single-crystal, nickel-based alloy.

The shot sleeve comprising the single crystal nickel-based alloy may comprise a protective oxide coating. The protective oxide coating is formed by heat treating the sleeve in the presence of a compound which modifies any oxide film on the surface of the shot sleeve. The protective oxide coating can also be formed by exposure of the shot sleeve to oxygen during the casting process. The modified oxide film allows for the diffusion of sulfur from the single crystal nickel-based alloy, thereby preventing any spallation of the oxide coating that might be caused by sulfur in the single crystal nickel-based alloy. Exemplary compounds that can be used include MgO, $Fe_2O_3$, $Cr_2O_3$, BaO, CaO, NiO, $Li_2O$, $Na_2O$, FeO, $Ta_2O_5$, $Y_2O_3$, $Gd_2O_3$, $SiO_2$, $ZrO_2$, $Ga_2O_3$, $Al_2O_3$, and CoO. Also useful are AlN, $Al_4C_3$, $Ni_2Mg$, $NiMg_2$, $Co_2Mg$, $MgCl_2MgF_2$, Fe, $MgAl_2O_4$, and $MgZrAl_2O_6$. Conditions for forming the protective oxide coating are described in WO 94/24320.

More specifically, the shot sleeve is heated in the presence of the modifying compound at a temperature at or above the temperature at which sulfur becomes mobile in the article and at or above the temperature at which the modifying compound reacts with the oxide film. Exemplary conditions are 1,050-1370° C. either in vacuum, an inert atmosphere, a reducing atmosphere, or a combination thereof. The modifying compound should have a vapor pressure of $10^{-8}$ to $10^{-3}$ bar under the above conditions. The protective oxide coating may have a thickness of 0.0001 to 0.005 inches, or, 0.0001 to 0.0010 inches.

In some embodiments the protective oxide coating has a thickness which is substantially uniform. Substantially uniform is defined as varying by less than 10% in cross sectional thickness, or less than 10% in thickness over the entirety of the coating. The protective oxide coating can be substantially continuous over the interior of the shot sleeve. Substantially continuous is defined as covering greater than or equal to 95%, or, greater than or equal to 97%, or, greater than or equal to 99% of the surface area.

In some embodiments the protective oxide coating provides improved lubricity compared to an uncoated shot sleeve of the same material. Protective oxide coatings having improved lubricity comprise one or more oxides of the following elements Fe, Co, Ni, Pd, Re, Cr, Mo as well as graphitic materials such as SiC.

Advantageously, embodiments described herein provide shot sleeves having several thousand shot cycles. That is, as will be appreciated by those of skill in the art, a ten-fold improvement (or greater) can be achieved with embodiments of the present disclosure. A low modulus single-crystal shot sleeve, as provided herein, can enable a high temperature die casting process to make improved thermo-mechanical-failure life of shot sleeves. Such improved shot sleeves can minimize issues with sleeve deflection and clearance control during die casting of components. Furthermore, advantageously, embodiments provided herein can enable increased fabrication rates and lower cost than alternative casting and forging processes.

The use of the terms "a," "an," "the," and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

Accordingly, the present disclosure is not to be seen as limited by the foregoing description, but is only limited by the scope of the appended claims.

What is claimed is:

1. A shot sleeve for high temperature die casting comprising a single crystal nickel-based alloy having less than 1 ppm sulfur, a single crystal nickel-based alloy doped with a sulfur active element, a single crystal nickel-based alloy having a protective oxide coating, or a combination of two or more of the foregoing; wherein the single crystal nickel-based alloy has a tangential modulus at room temperature of 18-22 Mpsi and a single crystal structure having axial symmetry in relation to the shot sleeve.

2. The shot sleeve of claim 1, wherein the single crystal, nickel-based alloy has less than 0.5 ppm sulfur.

3. The shot sleeve of claim 1, wherein the single crystal, nickel-based alloy is doped with one or more elements with consecutive atomic numbers of 57 to 71, inclusive, or yttrium.

4. The shot sleeve of claim 3, wherein the dopant is present in an amount of 1 ppm to 1000 ppm.

5. The shot sleeve of claim 1, wherein the protective oxide coating is formed in the presence of MgO, $Fe_2O_3$, $Cr_2O_3$, BaO, CaO, NiO, $Li_2O$, $Na_2O$, FeO, $Ta_2O_5$, $Y_2O_3$, $Gd_2O_3$, $SiO_2$, $ZrO_2$, $Ga_2O_3$, CoO, AlN, $Al_4C_3$, $Ni_2Mg$, $NiMg_2$, $Co_2Mg$, $MgCl_2MgF_2$, Fe, $MgAl_2O_4$, $MgZrAl_2O_6$, $Al_2O_3$, or a combination thereof.

6. The shot sleeve of claim 1, wherein the protective oxide coating has a thickness of 0.0001 to 0.005 inches.

7. The shot sleeve of claim 1, wherein the shot sleeve has an interior and exterior and the protective oxide coating is substantially continuous over the interior of the shot sleeve.

8. The shot sleeve of claim 1, wherein the protective oxide coating is applied to the shot sleeve.

9. The shot sleeves of claim 1, wherein the protective oxide coating is formed from one or more metals in the single crystal nickel-based alloy.

10. A method of reducing oxidation of a high temperature die casting shot sleeve comprising:

reducing a sulfur content in a single crystal nickel-based alloy of the shot sleeve to less than 1 ppm, doping a single crystal nickel-based alloy of the shot sleeve with a sulfur active agent;

providing a protective oxide coating to a single crystal nickel-based alloy of the shot sleeve, or a combination of two or more of the foregoing; wherein the single crystal nickel-based alloy has a tangential modulus at room temperature of 18-22 Mpsi and a single crystal structure having axial symmetry in relation to the shot sleeve.

11. The method of claim 10, wherein the single crystal, nickel-based alloy has less than 0.5 ppm sulfur.

12. The method of claim 10, wherein the single crystal, nickel-based alloy is doped with one or more elements with consecutive atomic numbers of 57 to 71, inclusive, or yttrium.

13. The method of claim 12, wherein the dopant is present in an amount of 1 to 1000 ppm.

14. The method of claim 10, wherein the protective oxide coating is formed in the presence of MgO, $Fe_2O_3$, $Cr_2O_3$, BaO, CaO, NiO, $Li_2O$, $Na_2O$, FeO, $Ta_2O_5$, $Y_2O_3$, $Gd_2O_3$, $SiO_2$, $ZrO_2$, $Ga_2O_3$, CoO, AlN, $Al_4C_3$, $Ni_2Mg$, $NiMg_2$, $Co_2Mg$, $MgCl_2MgF_2$, Fe, $MgAl_2O_4$, $MgZrAl_2O_6$, $Al_2O_3$, or a combination thereof.

15. The method of claim 10, wherein the protective oxide coating has a thickness of 0.0001 to 0.005 inches.

16. The method of claim 10, wherein the protective oxide coating is substantially continuous over an interior of the shot sleeve.

17. The method of claim 10, wherein the protective oxide coating is formed at a temperature of 1050 to 1370° C.

18. The method of claim 10, wherein the protective oxide coating is formed during casting.

19. The method of claim 10, wherein the protective oxide coating is applied to the shot sleeve.

* * * * *